US009695555B2

(12) United States Patent
Mäenpää et al.

(10) Patent No.: US 9,695,555 B2
(45) Date of Patent: Jul. 4, 2017

(54) METHOD TO FORM A RAIL JOINT, AND A RAIL JOINT

(71) Applicant: KONECRANES PLC, Hyvinkää (FI)

(72) Inventors: Kari Mäenpää, Hyvinkää (FI); Esa Ojapalo, Hyvinkää (FI)

(73) Assignee: KONECRANES GLOBAL CORPORATION, Hyvinkää (FI)

( * ) Notice: Subject to any disclaimer, the term of this patent is extended or adjusted under 35 U.S.C. 154(b) by 74 days.

(21) Appl. No.: 14/764,371

(22) PCT Filed: Jan. 30, 2014

(86) PCT No.: PCT/FI2014/050074

§ 371 (c)(1),
(2) Date: Jul. 29, 2015

(87) PCT Pub. No.: WO2014/118437

PCT Pub. Date: Aug. 7, 2014

(65) Prior Publication Data

US 2015/0361621 A1 Dec. 17, 2015

(30) Foreign Application Priority Data

Jan. 31, 2013 (FI) ..... 20135092

(51) Int. Cl.
*E01B 11/44* (2006.01)
*E01B 11/24* (2006.01)
(Continued)

(52) U.S. Cl.
CPC ..... *E01B 11/44* (2013.01); *B66C 7/08* (2013.01); *B66C 7/14* (2013.01); *E01B 11/24* (2013.01); *Y10T 29/49828* (2015.01)

(58) Field of Classification Search
CPC ..... E01B 11/24; E01B 11/46; E01B 11/56; E01B 11/58; E01B 11/60; B66C 7/08; B66C 7/14
(Continued)

(56) References Cited

U.S. PATENT DOCUMENTS 795,733 A * 7/1905 Robins ..... E01B 11/24 238/232
1,234,001 A * 7/1917 Fitzgerald ..... E01B 11/24 238/232
(Continued)

FOREIGN PATENT DOCUMENTS

CN 1408953 A 4/2003
CN 2813686 Y 9/2006
(Continued)

*Primary Examiner* — Jason C Smith
(74) *Attorney, Agent, or Firm* — Birch, Stewart, Kolasch & Birch, LLP

(57) ABSTRACT

The invention relates to a method to form a rail joint, in which staggerings (6, 7) corresponding to each other are made in joinable solid-profile rail ends (4, 5) of parts (2, 3) of a rail (1) so that when a completed rail joint is viewed from above the rail heads bond; both rail ends are secured to a corresponding mounting; the rail ends secured to the mountings are brought against each other whereby said bonding is established; and the mountings that are against each other are secured to one another. The staggerings (6, 7) are made in such a manner that the lower edges (4*a*, 5*a*) of the rail ends (4, 5) are left substantially unstaggered whereby the staggerings extend from these lower edges towards the top surfaces or the rail ends; and the rail ends (4, 5) are welded by their lower edges (4*a*, 5*a*) at their entire width to their mountings (8, 9). The invention also relates to a rail joint made by this method.

12 Claims, 2 Drawing Sheets

(51) Int. Cl.
*B66C 7/14* (2006.01)
*B66C 7/08* (2006.01)

(58) Field of Classification Search
USPC ..... 238/151, 232
See application file for complete search history.

(56) References Cited

U.S. PATENT DOCUMENTS

| | | | | |
|---|---|---|---|---|
| 1,292,520 | A * | 1/1919 | Miehle | E01B 11/24 238/232 |
| 2,633,302 | A * | 3/1953 | Pershing | E01B 11/44 238/164 |
| 2013/0164078 | A1* | 6/2013 | Spies | B66C 7/02 403/270 |
| 2013/0186968 | A1* | 7/2013 | Song | E01B 11/52 238/164 |
| 2015/0361621 | A1* | 12/2015 | Maenpaa | E01B 11/24 238/151 |

FOREIGN PATENT DOCUMENTS

| | | | |
|---|---|---|---|
| CN | 2871615 | Y | 2/2007 |
| CN | 101324047 | A | 12/2008 |
| EP | 1 164 222 | A1 | 12/2001 |
| GB | 615279 | A | 1/1949 |
| JP | 4980822 | A | 8/1974 |
| JP | 10-338901 | A | 12/1998 |
| JP | 2004-231364 | A | 8/2004 |
| RU | 94033093 | A1 | 7/1996 |
| WO | WO 2012/034895 | A9 | 3/2012 |

* cited by examiner

METHOD TO FORM A RAIL JOINT, AND A RAIL JOINT

BACKGROUND OF THE INVENTION

The invention relates to a method to form a rail joint, in which staggerings corresponding to each other are made in joinable solid-profile rail ends of parts of a rail so that when a completed rail joint is seen from above the rail heads bond; both rail ends are secured to corresponding mountings; the rail ends secured to the mountings are brought against each other whereby said bonding is established; and the mountings that are against each other are secured to each another. The invention additionally relates to a rail joint made with this method.

Such a rail joint is used, for example, in main supports of a crane, which are made of two or more blocks, which are joined at the final assembly site by a flange-strap joint. Typically, the part between the rail blocks of the crane car is welded at the final assembly site, and the mating surfaces are finished and painted after the assembly. The finishing work on a rail requires special skills, special tools and time, which has to be taken into account at the time the delivery schedule and resources are planned. Furthermore, the finishing work during final assembly is often expensive special work under demanding conditions, such as a tight schedule, working on top of high structures, temporary working levels, organising hot work permits, the weather in outdoors installation work, etc.

In case the rail joint itself is not welded, it is staggered between two blocks so that the bearing wheel of a truck, travelling along the rail moves from one block to the next as smoothly as possibly. It is difficult to implement the welding of a staggered rail to the mounting with adequate support and firmness for the rail.

In a prior art method, to make a rail joint, beams acting as the mountings for the rails to be joined are first brought end-to-end, and joined by means of bolts at the sides of the beams. The ends of the rails to be joined, mounted on the joined beams, are located at a distance from the beam joining edges. A separate rail piece is placed between the rail ends which are apart and to be joined, which is welded to the rail ends to be joined from above by fill welding. Then, the bolted joints combining the beams and rails are opened, the beams are moved apart, the root of the joined rail is welded, the welded joint is tidied up, and the dismantled bolted joints are joined anew. This solution is most laborious and furthermore provides an unsatisfactory solution both from the viewpoint of the functioning and durability of the rail joint.

Based on publication WO 2012/034895 A9, a joining method is known for rail ends of an open-profile capsular rail, in which jointing sleeves parallel to the rail are welded to the sides of the ends of the rail segments to be joined. The segments are joined end-on-end with bolts through the jointing sleeves without a welded joint. This method meant for rail joints in open-profile rails with lighter loads is not suitable for joints in solid profile rails because it does not allow a strong enough and faultlessly operating rail joint to be achieved for more heavy-duty applications that require solid profile rails.

Also known is a staggered rail joint referred to initially, in which the staggering continues evenly from the top to the bottom of the rail ends to be joined in the rail joint, whereby both rail ends staggered all the way down are welded to a mounting having even edges, by the half of the staggering that in any one case extends to the edge of the mounting, whereas the half of the staggering which is further from the edge of the mounting rests freely on the mounting. This solution produces a reasonably good end result, but even here the load is neither evenly distributed at the joint nor is it not stable enough in long-term use.

SUMMARY OF THE INVENTION

An object of the invention is to develop the rail joint method and rail joint described in the beginning in such a manner that the aforementioned problems are solved. This object is achieved by the method and rail joint according to the invention, which are characterised by what is stated in the independent claims. Preferred embodiments of the invention are disclosed in the dependent claims.

The invention is based on that the lower edges of the rail ends to be joined are substantially left entirely unstaggered, whereby the rail ends can be welded by these lower edges at their full width to the corresponding mounting. Only the rail end areas extending upward from the lower edge are staggered, which is fully adequate to accept the side thrust directed at the rail, in particular as the lower edges are firmly mounted to the mounting by their entire width.

When the staggerings are advantageously rectangular, advantageously comprising a flat wall longitudinal to the rail, and joining the wall, flat front walls, perpendicular in relation to the sides of the rails, the front walls at both rail ends forming angles of the same size in relation to the transversal vertical plane of the rail, the top surface of the rail joint ends is maintained as forced at always the same level, ensuring the smooth transition across the rail joint of the wheels of a rail vehicle moving on the rails. This implementation of a rail joint according to the invention is at the same time the simplest and most advantageous one. Of course, the staggerings according to the invention can be shaped in numerous others ways, too, because the only essential fact is the missing of the staggerings in the area of the lower edge of the rail end, where the welding into the mounting takes place.

Other benefits of the invention include, for example, that no welding is required at the actual assembly site, since the only task to be completed may be comprised only of joining together elements consisting of a mounting and rails secured to it and welded at an engineering plant, and no finalizing or painting. To mention one advantage, it is possible to deliver the beams to the final assembly site in shorter sections, packed in a container, for example.

LIST OF FIGURES

The invention is now described in closer detail by means of one preferred embodiment and with reference to the accompanying drawings, in which FIG. 1 shows two rail ends to be joined as a perspective sketch;

DETAILED DESCRIPTION OF THE INVENTION

Figure 1:
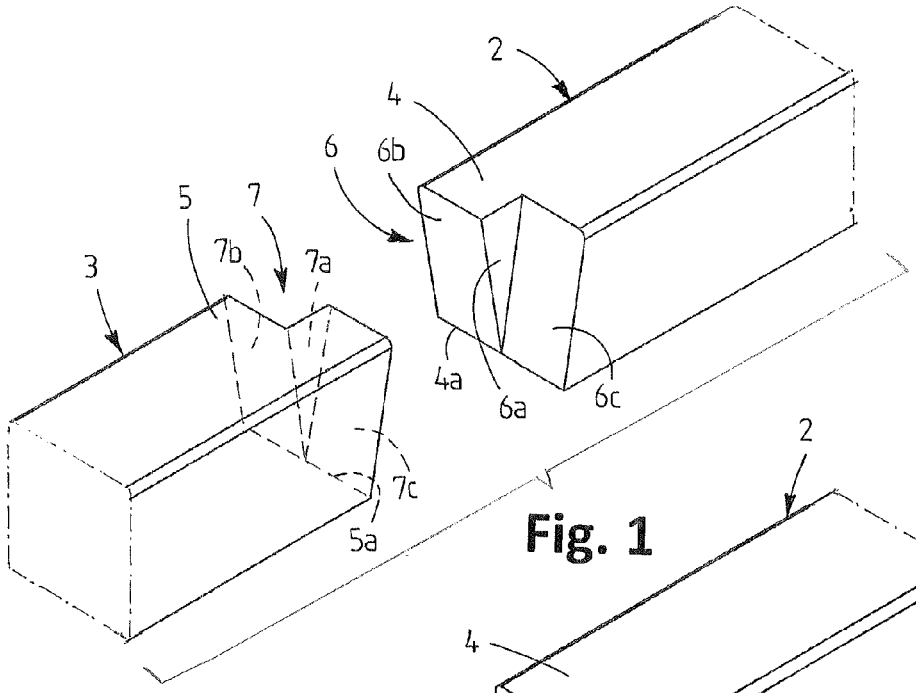
Figure 2:
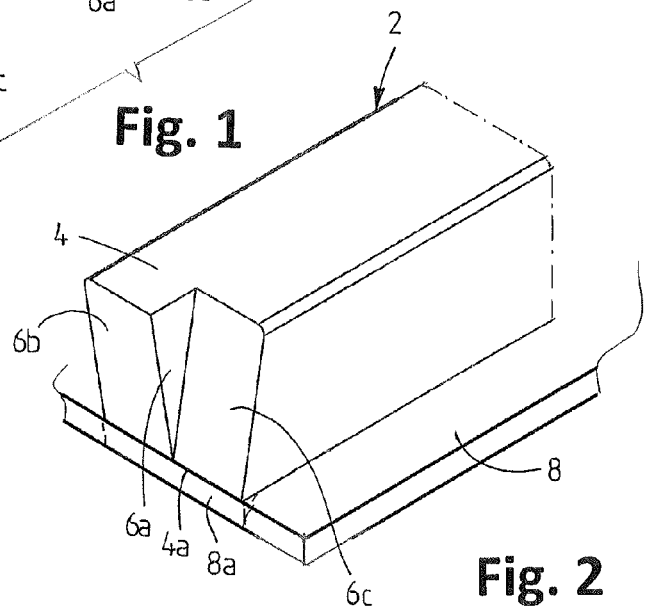
FIG. 2 shows the welding of one rail end to its mounting as a perspective sketch.
Figure 3:
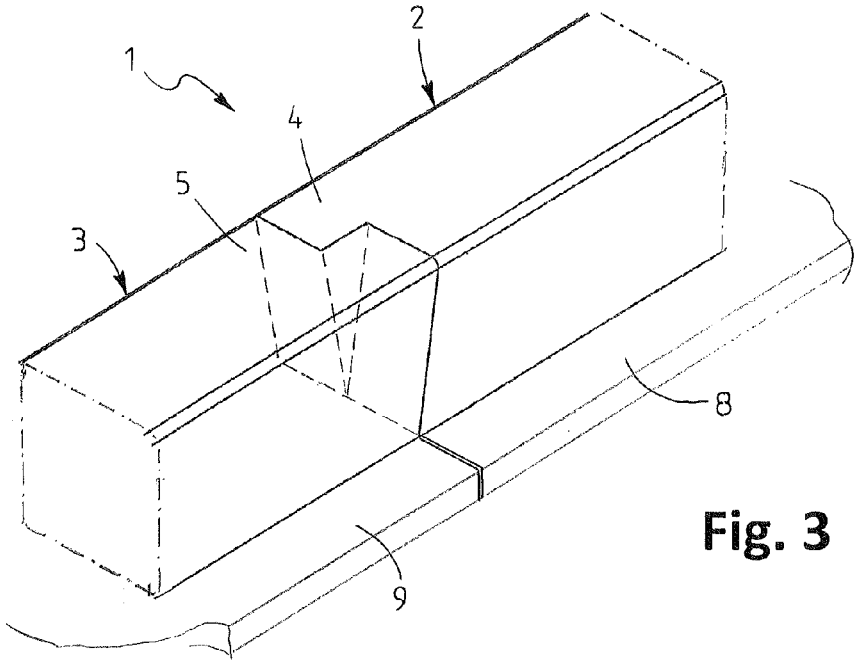
FIG. 3 shows a completed rail joint, that is, the rail ends of FIG. 1 connected to each other, also as a perspective sketch.
Figure 4:
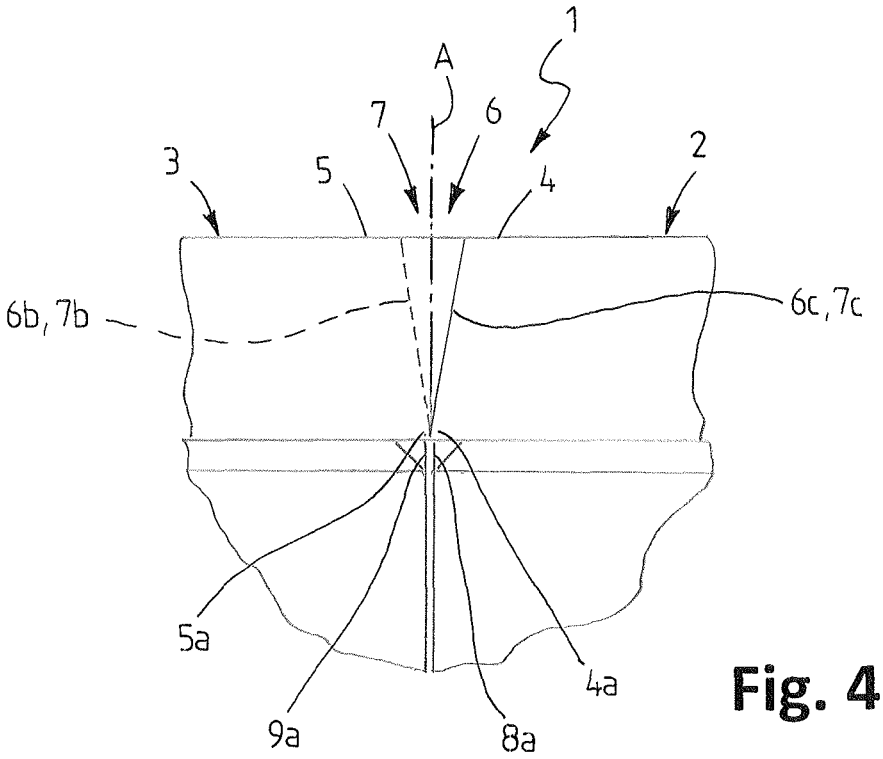
FIG. 4 is a side view of the rail joint according to FIG. 3.
Figure 5:
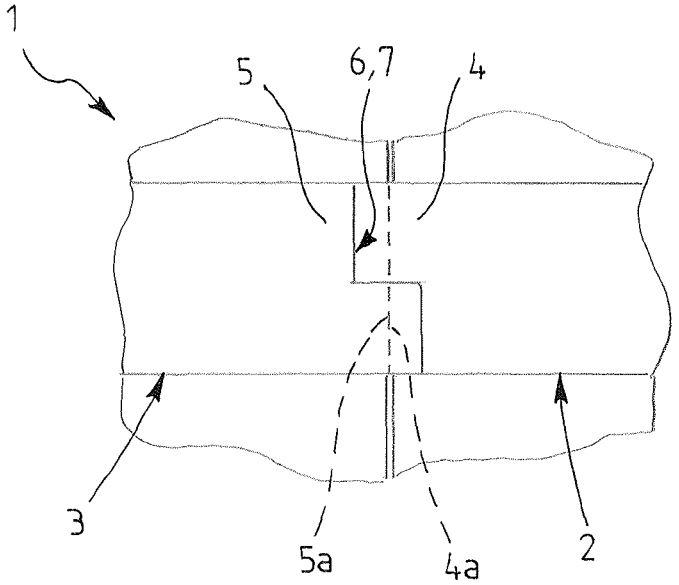
FIG. 5 is a top view of the rail joint according to FIG. 3.

With reference to the drawings, the rail joint according to the invention is formed between solid profile rail ends 4 and 5 to be joined in parts 2 and 3 in a rail 1. The joint comprises staggerings 6, 7 corresponding to each other and connected to each other in a shape-locked manner in the rail ends 4 and 5 which are opposite each other and to be joined, so formed that in a completed rail joint, as seen from above, the rail ends 4 and 5 bond.

Instead, the lower edges 4*a* and 5*a* of the rail ends are substantially unstaggered, and the staggerings 6 and 7 extend from these substantially unstaggered lower edges 4*a* and 5*a* of the rail ends 4 and 5 in the direction of the top surfaces of the rail ends 4 and 5.

The rail ends 4 and 5 are welded by their lower edges 4*a* and 5*a* at their entire width to the end edges 8*a* and 8*b* of the mountings 8 and 9, the end edges being located in the same vertical plane with the lower edges of the rail ends 4 and 5, and, with a bolted joint between the mountings 8 and 9, the rail ends 4 and 5 are brought together as a rail joint. The welding is typically carried out at an engineering workshop, and it is usually only required at the site of use of the rail joint to perform said joint of mountings 8 and 9. Of course, the parts 2 and 3 or the rail 1 are secured to their mountings 8 and 9 where needed also by the edges of the parts 2 and 3 by methods known per se.

The staggerings 6 and 7 have been formed substantially rectangular so that the staggering of both rail ends 4 and 5 comprises a flat wall 6*a* and 7*a* substantially longitudinal to the rail 1, and joining the wall, front walls 6*b*, 6*c* and 7*b*, 7*c*, perpendicular in relation to the sides of the rail 1.

The front walls 6*b*, 6*c*, and 7*b*, 7*c* of both rail ends 4 and 5 form equal angles in relation to the transversal vertical plane of the rail 1, which means that the parts 2 and 3 of the rail 1, which are disclosed here, are identical.

The structure according to the invention can be utilized in all types of cranes in which the rail of the main support can be welded together at the site of the final assembly without the need to weld. Such cranes can be, for example, bridge cranes, ship-to-shore cranes (STS), or an apparatus on a mobile platform.

The above description of the invention is only intended to illustrate the basic idea of to the invention. A person skilled in the art may thus vary its details within the scope of the accompanying claims. Consequently, the staggerings according to the invention can be shaped in numerous other ways, too, because the only essential fact is the missing of the staggerings in the area of the lower edge of the rail end, where the welding into the mounting takes place.

The invention claimed is:

1. A method to form a rail joint, said method comprising the steps of:

making staggerings corresponding to each other in joinable solid-profile rail ends of parts of a rail in such a manner that when a completed rail joint is seen from above the rail ends bond;

securing both rail ends to corresponding mountings;

bringing the rail ends secured to the mountings against each other, whereby said bonding is established; and securing the mountings opposite each other to each other, wherein the staggerings are made in such a manner that the lower edges of the rail ends are substantially left unstaggered, whereby the staggerings extend from these substantially unstaggered lower edges of the rail ends towards the top surfaces or the rail ends, and wherein the rail ends are welded by their lower edges at their full width to their mountings.

2. The method as claimed in claim 1, wherein the staggerings are formed substantially rectangular so that the staggering of both rail ends comprises a wall substantially longitudinal to the rail and, connected to it, front walls substantially perpendicular to the sides of the rail.

3. The method as claimed in claim 2, wherein all the walls of the staggering are made as flat walls.

4. The method as claimed in claim 2, wherein the front walls of both rail ends form equal angles in relation to the transversal vertical plane of the rail.

5. The method as claimed in claim 1, wherein the lower edges of the rail ends and the corresponding front edges of the mountings are positioned in the same vertical plane for welding.

6. The method as claimed in claim 1, wherein the rail joint is established in the rail of the main support of a crane.

7. A rail joint comprising:

staggerings corresponding to each other in joinable solid-profile rail ends of parts of a rail, formed in such a manner that when a completed rail joint is seen from above the rail ends bond; and whereby both rail ends are secured to corresponding mountings which are joined together, wherein the lower edges of the rail ends are substantially unstaggered, whereby the staggerings extend from these substantially unstaggered lower edges of the rail ends towards the top surfaces or the rail ends, and wherein the rail ends are welded by their lower edges at their full width to their mountings.

8. The rail joint as claimed in claim 7, wherein the staggerings are formed substantially rectangular so that the staggering of both rail ends comprises a wall substantially longitudinal to the rail and, connected to it, front walls substantially perpendicular to the sides of the rail.

9. The rail joint as claimed in claim 8, wherein all the walls of the staggering are flat.

10. The rail joint as claimed in claim 8, wherein the front walls of both rail ends form equal angles in relation to the transversal vertical plane of the rail.

11. The rail joint as claimed in claim 7, wherein the lower edges of the rail ends and the corresponding end edges of the mountings are positioned in the same vertical plane.

12. The rail joint as claimed in claim 7, wherein the rail joint is established in the rail of the main support of a crane.

* * * * *